US011628376B2

(12) United States Patent
Cirolia

(10) Patent No.: US 11,628,376 B2
(45) Date of Patent: Apr. 18, 2023

(54) STACKING TOY SYSTEM

(71) Applicant: John P. Cirolia, Bronx, NY (US)

(72) Inventor: John P. Cirolia, Bronx, NY (US)

( * ) Notice: Subject to any disclaimer, the term of this patent is extended or adjusted under 35 U.S.C. 154(b) by 0 days.

(21) Appl. No.: 17/498,174

(22) Filed: Oct. 11, 2021

(65) Prior Publication Data

US 2022/0258065 A1 Aug. 18, 2022

Related U.S. Application Data

(63) Continuation of application No. 17/177,037, filed on Feb. 16, 2021, now Pat. No. 11,141,675.

(51) Int. Cl.
*A63H 33/10* (2006.01)

(52) U.S. Cl.
CPC ..... *A63H 33/10* (2013.01)

(58) Field of Classification Search
CPC .... A63H 33/04; A63H 33/042; A63H 33/065; A63H 33/10; A63H 33/14
USPC ..... 446/120, 212, 122, 124, 125
See application file for complete search history.

(56) References Cited

U.S. PATENT DOCUMENTS 3,303,569 A * 2/1967 Wyatt ..... G01C 9/34 33/343
3,584,212 A * 6/1971 Hansen ..... G01C 9/18 362/802
3,785,097 A * 1/1974 Seymour ..... E04G 21/14 52/223.7
4,168,578 A * 9/1979 VanderWerf ..... G01C 9/28 33/382
D288,541 S * 3/1987 VanderWerf ..... D10/69
4,976,040 A * 12/1990 Mish ..... G01C 9/28 33/372
5,864,956 A * 2/1999 Dong ..... G01C 15/105 33/286
5,934,037 A * 8/1999 Bundra ..... E04B 2/08 52/603
6,421,928 B1 * 7/2002 Miller ..... A47G 1/205 33/669
6,668,417 B1 * 12/2003 Slattery ..... G01C 9/26 15/235.4
6,779,632 B1 * 8/2004 Parks, III ..... E06C 7/003 182/200
7,231,740 B2 * 6/2007 Jirele ..... A63J 1/00 108/53.5
7,631,435 B2 * 12/2009 Brown ..... G01C 15/10 33/410
7,676,940 B2 * 3/2010 Spaulding ..... G01C 9/28 33/383
7,730,626 B2 * 6/2010 Charpentier ..... E04G 21/1825 33/518
8,099,918 B2 * 1/2012 Marsh ..... E04B 2/30 52/293.3
8,475,226 B2 * 7/2013 Comfort ..... A63H 33/08 446/168
9,429,424 B2 * 8/2016 Butler ..... B43L 7/0275
10,194,760 B2 * 2/2019 Frazier, Jr. ..... A47G 1/205
(Continued)

*Primary Examiner* — Joseph B Baldori
(74) *Attorney, Agent, or Firm* — RC Trademark Company

(57) ABSTRACT

According to some embodiments, a first toy body comprises a first level oriented in a first direction, and a second level oriented in a second direction. A second toy body comprises a third level oriented in the first direction, and a fourth level oriented in the second direction, wherein the first direction is perpendicular to the second direction.

15 Claims, 6 Drawing Sheets

200

(56) References Cited

U.S. PATENT DOCUMENTS

| | | | | |
|---|---|---|---|---|
| 11,255,651 | B2 * | 2/2022 | Medina | G01C 9/34 |
| 11,286,667 | B2 * | 3/2022 | Giles | E04C 5/0604 |
| 2007/0197123 | A1 * | 8/2007 | Olivo | G01C 9/26 446/123 |
| 2009/0071023 | A1 * | 3/2009 | Maruyama | G01C 9/28 33/374 |
| 2011/0092129 | A1 * | 4/2011 | Aggar | A63H 33/062 446/85 |
| 2014/0267703 | A1 * | 9/2014 | Taylor | G05D 1/0234 348/139 |
| 2019/0339052 | A1 * | 11/2019 | Vuylsteke | G01B 5/0004 |
| 2020/0038772 | A1 * | 2/2020 | Wong | A63H 33/04 |
| 2022/0185624 | A1 * | 6/2022 | Tong | B66B 19/00 |

* cited by examiner

200

300

400

200

STACKING TOY SYSTEM

BACKGROUND

Toys that stack on each other have been a constant playtime staple for children. Conventional stacking toys (e.g., wooden or plastic blocks) are limited in how high a child can stack the blocks as the blocks tend to get out of balance as they are stacked higher and higher. Eventually, the blocks crash down to the ground. Since children love the idea of stacking blocks higher and higher, a stacking toy system that facilitates stacking toys higher than conventional toys is desirable.

SUMMARY

Some embodiments described herein relate to stacking toy system. The stacking toy system comprises a first toy body that includes a first level oriented in a first direction, and a second level oriented in a second direction. A second toy body includes a third level oriented in the first direction, and a fourth level oriented in the second direction, wherein the first direction is perpendicular to the second direction.

DETAILED DESCRIPTION

In the following detailed description, numerous specific details are set forth in order to provide a thorough understanding of the embodiments. However, it will be understood by those of ordinary skill in the art that the embodiments may be practiced without these specific details. In other instances, well-known methods, procedures, and components have not been described in detail so as not to obscure the embodiments.

Figure 1:
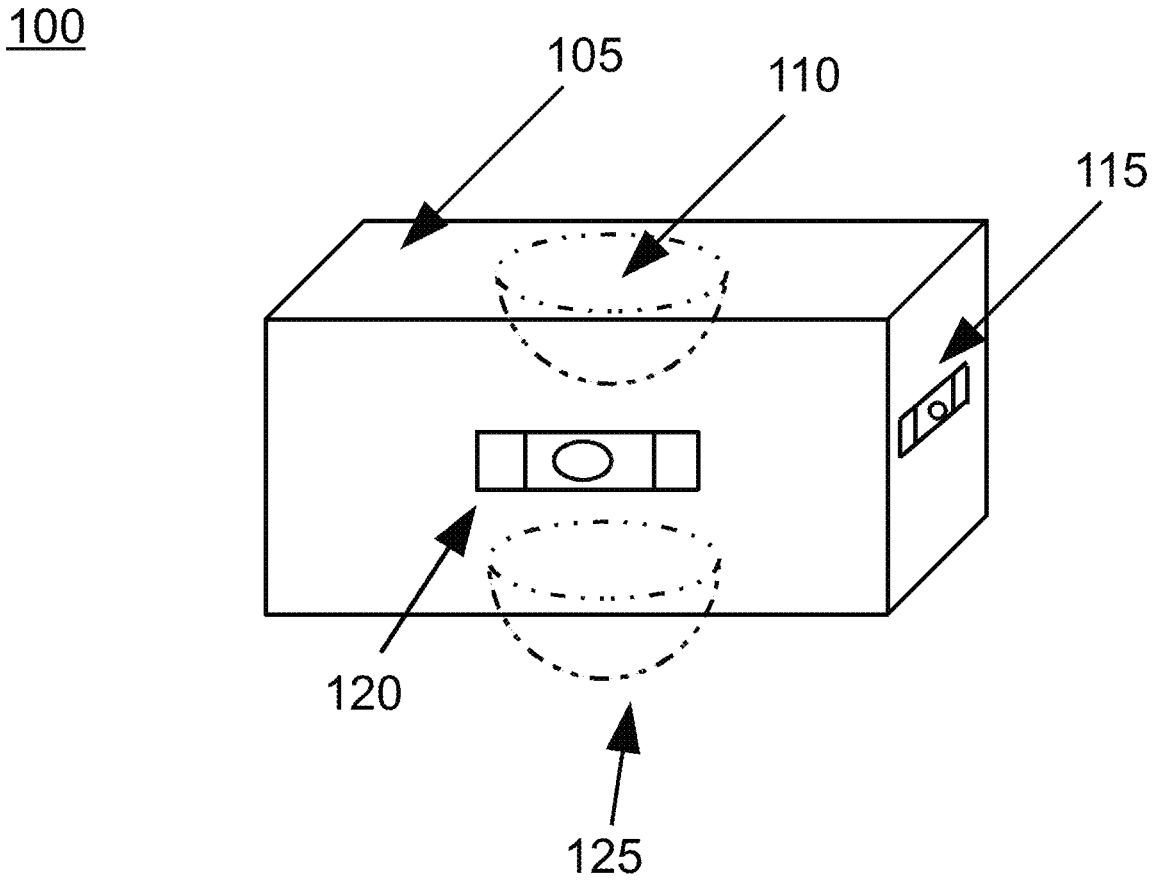
FIG. 1 illustrates a single stacking toy in accordance with some embodiments.

The present embodiments described herein relate to a novel stacking toy system that allows toys to be stacked higher than conventional stacking toys. Referring now to FIG. 1, a stacking toy 100 is illustrated. The stacking toy 100 comprises a toy body 105, a first level 115 and a second level 120. The first level 115 and the second level 120 may each comprise a spirit level, bubble level, or any level designed to indicate whether an object may be level (e.g., horizontal). Thus, with the first level 115 and the second level 120 a user may determine if the toy body 105 is level in an X axis and level in a Y axis where the x axis and y axis are substantially perpendicular to each other. The first level 115 and the second level 120 may each comprise a vial that comprises a constant inner diameter at each viewing point. Each vial may be incompletely filled with a liquid such that a bubble naturally rests in a center of the vial to indicate that the vial is level.

The toy body 105 may comprise any toy body shape. For example, the toy body 105 may comprise a shape of, but it not limited to, a block, a rectangle, a triangle, a square, an animal, or a motorized vehicle. As illustrated in FIG. 1, the first level 115 may be located on a first side of the toy body 105 and the second level 120 may be located on a second side of the toy body 105. In some embodiments, the first side and the second side may be substantially perpendicular to each other. The first level 115 and the second level 120 may be surface mounted on the toy body 105. However, in some embodiments, the first level 115 and the second level 120 may be at least partially embedded within the toy body 105. The toy body 105 may be comprised of one or more materials, such as, but not limited to wood, plastic or metal.

In some embodiments, a top side may define a concave portion 110 (e.g., an indentation in the toy body) and a bottom side may define a convex portion 125 (e.g., a raised section of the toy body). The convex portion 120 may be slightly larger than the concave portion 110 so that, when stacked, the top side of a first toy body will not be flush with a bottom side of a second toy body. In other words, a space is formed between the first surface associated with the first toy body and a second surface associated with the second toy body. This may allow for the room needed to make adjustments so that a stacked toy body will be substantially level.

Figure 2:
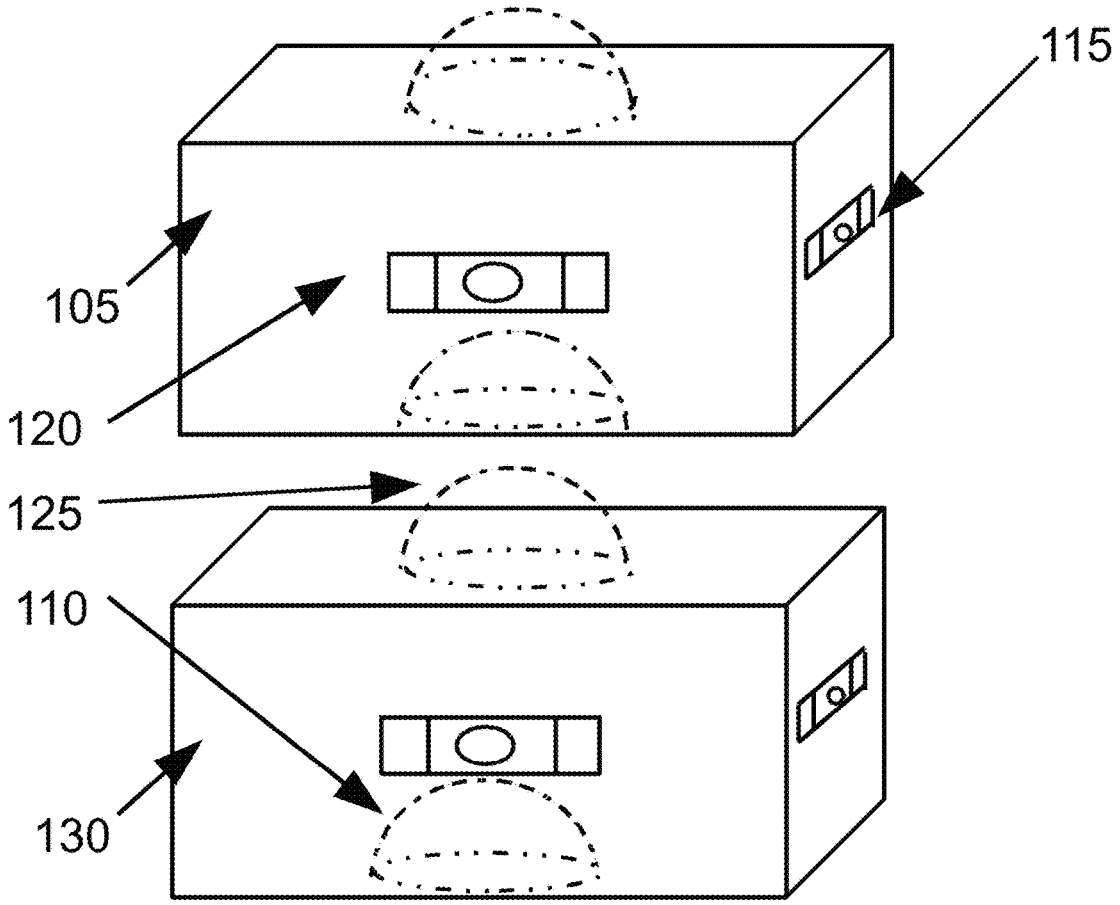
FIG. 2 illustrates a stacking toy system in accordance with some embodiments.

For example, and now referring to FIG. 2, a stacking toy system 200 that comprises a plurality of toy bodies is illustrated. As stated above, when a first toy body 105 is stacked on a second toy body 130 such that convex portion 125 fits into concave portion 110, a space is formed between the first toy body 105 and second toy body 130 to allow for leveling adjustments.

For illustrative purposes, and to aid in understanding features of the specification, an example will now be introduced. This example is not intended to limit the scope of the claims. In some embodiments, a child wants to stack toy body 105 on top of toy body 130. Once toy body 105 is place on top of toy body 130, a child may be able to move toy body 105 back and forth and left and right (due to the space) until the first level 115 located on the first side of the toy body 105 indicates that the toy body 105 is level in an X axis. Likewise, the child may move toy body 105 back and forth and left and right (due to the space) until the second level 120 located on the second side of the toy body 105 indicates that the toy body 105 is level in an Y axis. The child may then add another block on top of toy body 105 and continue stacking blocks. By leveling each individual toy body, a plurality of toy bodies may be stacked higher than conventional toys.

Figure 3:
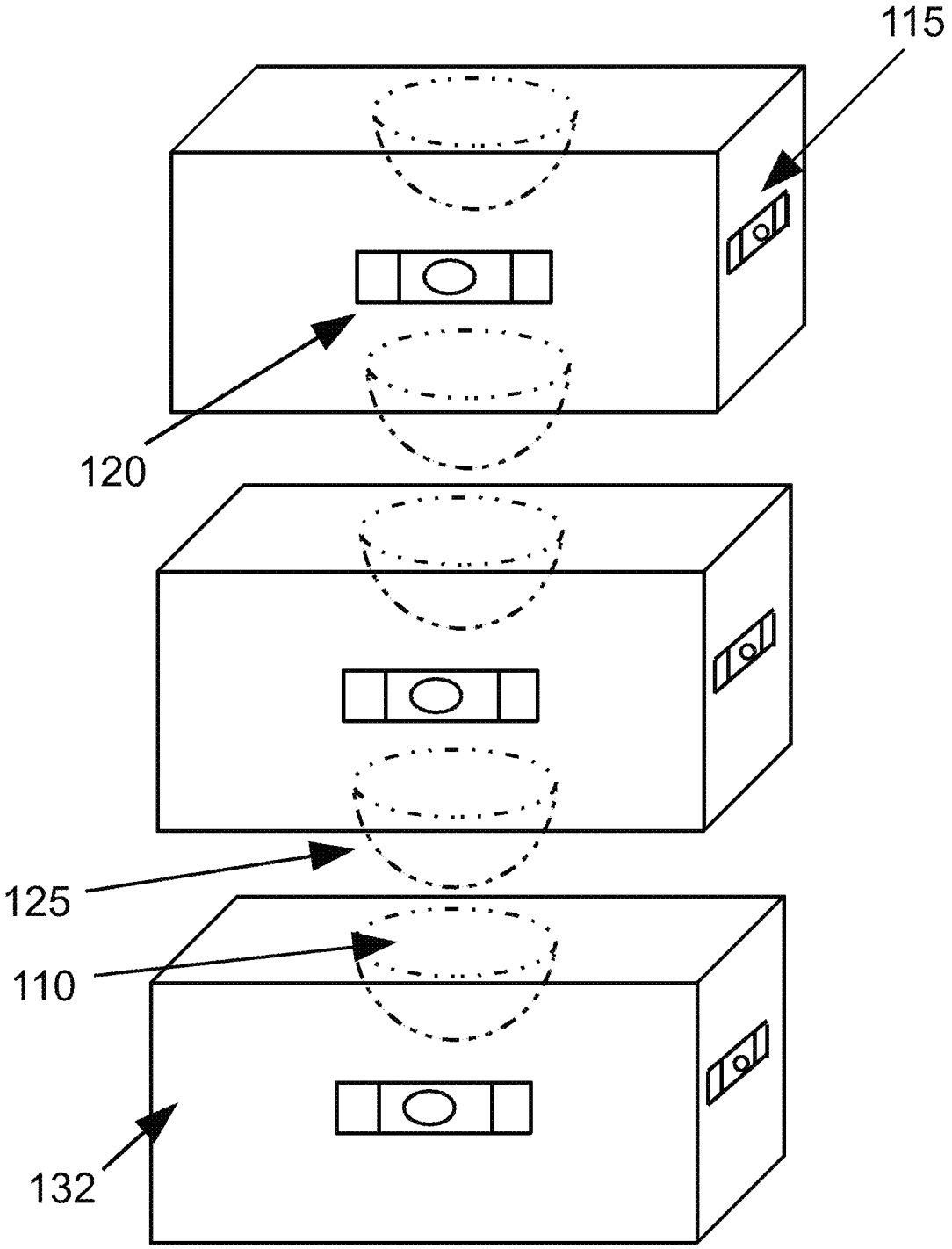
FIG. 3 illustrates a stacking toy system in accordance with some embodiments.

Referring now to FIG. 3, an embodiment of a stacking toy system 300 comprising a plurality of toy bodies is illustrated. FIG. 3 illustrates an embodiment that utilizes a starting toy body 132 that lacks a concave portion 110 or a convex portion 125 on a bottom portion of the toy body 132. This creates a solid base for stacking.

Figure 4:
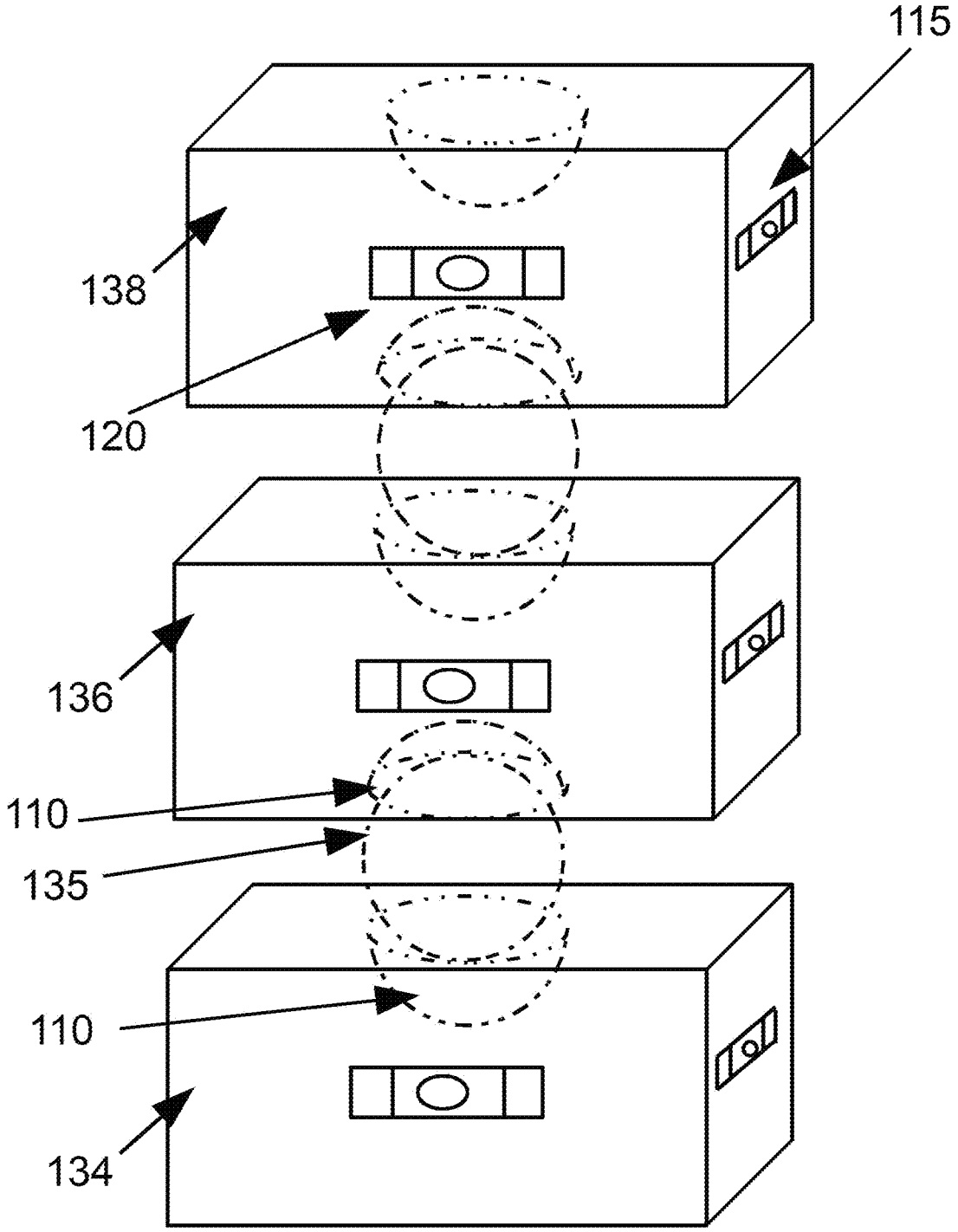
FIG. 4 illustrates a stacking toy system in accordance with some embodiments.

In some embodiments, such as stacking toy system 400 of FIG. 4, each toy body 134/136/138 may comprise a first concave portion on a top side and a second concave portion on a bottom side. Having the concave sections on both a top surface and on a bottom surface may allow for the use of a joiner object 135. The joiner object 135 may comprise, but not limited to, a ball, a round object or an oblong shaped object, that may be placed between two toy bodies and be located (e.g., rest) in the concave sections. Having the joiner object 135 between the two toy bodies allows the upper toy body to be moved/rotated in a front to back or side to side general direction to create a level toy body for further stacking.

Figure 5:
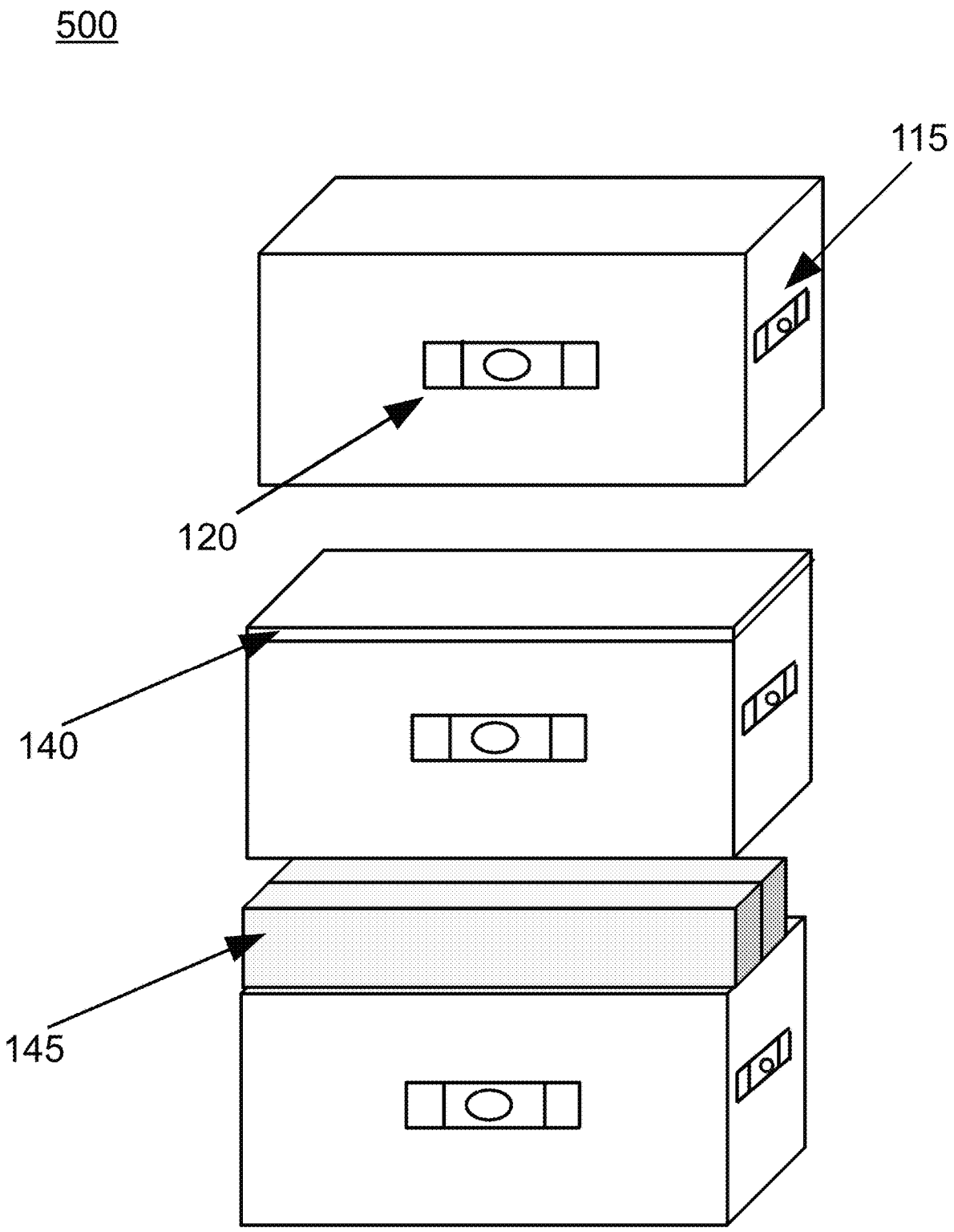
FIG. 5 illustrates a stacking toy system in accordance with some embodiments.

FIG. 5. Illustrates the use of moldable section 140 or a moldable object 145 that may be used for allowing the upper toy body to be moved/rotated in a front to back or side to side general direction to create a level toy body for further stacking.

The moldable section 140 may comprise a moldable section or area of the toy body that lays across a surface of a toy body. The moldable section 140 may substantially cover the surface of the toy body. In some embodiments, the moldable section 140 may be permanently affixed to the toy body. However, in other embodiments, the moldable section 140 may be removably coupled to the toy body.

The moldable object 145 may comprise objects that are comprised of a moldable material that may be placed between two toy bodies. The moldable object 145 may cover only a portion of a surface of the toy body or, in some embodiments, the moldable object 145 may substantially cover an entire surface of one side of the toy body.

The moldable section 140 and/or the moldable object 145 may be filled with a moldable material such as, but not limited, to sand, foam, beads, kinetic sand, putty, and gel.

Figure 6:
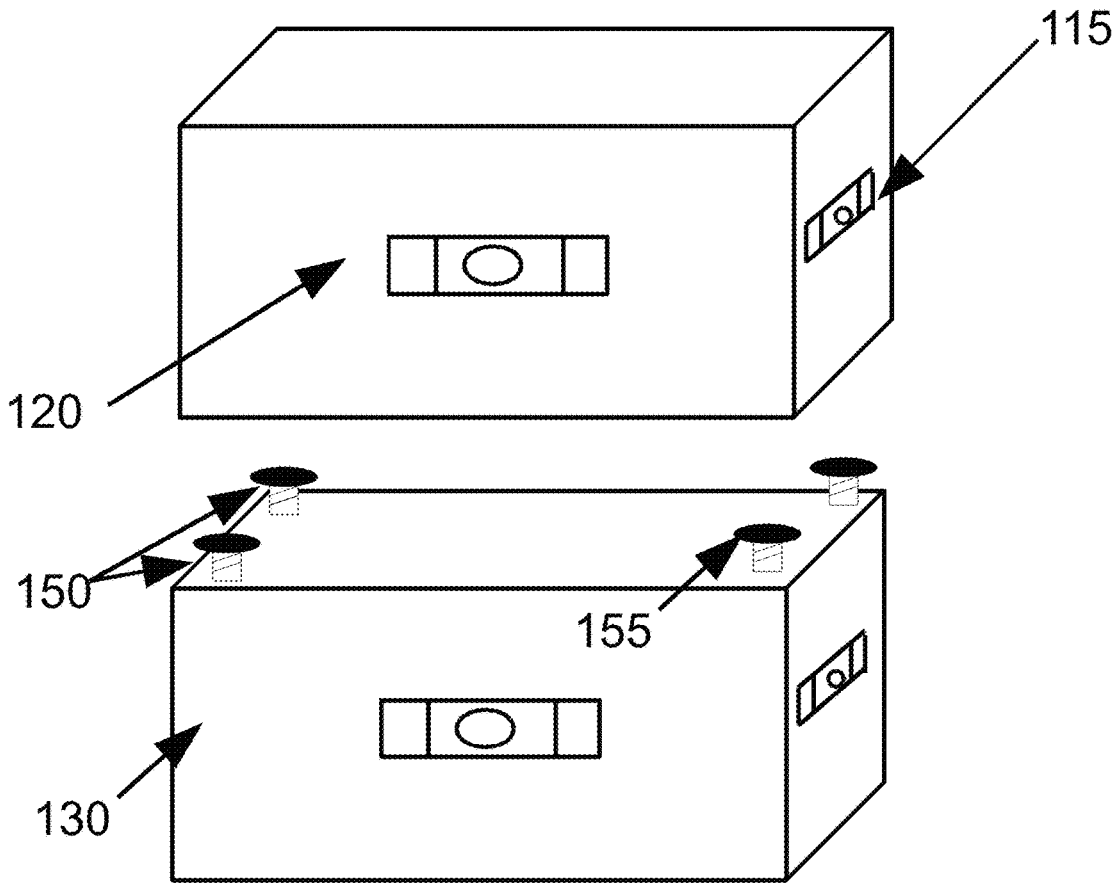
FIG. 6 illustrates a stacking toy system in accordance with some embodiments.

Referring now to FIG. 6, a toy body 130 may comprise one or move leveling posts 150 that may be located on a top surface of a toy body 130. The leveling posts 150 may comprise, for example, a post, a cam, or a screw and may be located in corners of the toy body 130. The leveling posts 150 allow a toy body to be jacked up or down.

Each of the plurality of leveling posts 150 may move, up or down, independently to level a block that rests on top of the one or more leveling posts 150. In some embodiments, the leveling posts 150 may be raised or lowered (e.g., screwed) into the toy body to adjust an individual height of each individual leveling post. In some embodiments, each leveling post 150 may be threaded. Each leveling post may also comprise a top portion 155 that extends beyond a diameter of the leveling post to allow for each leveling post 150 to be turned when another toy block is resting on top of the toy block 130. In some embodiments, the top option 155 may function as a wheel that you turn to jack a toy body up or down. In some embodiments, the top portion may actually be located anywhere on the leveling post 150 (e.g., on a top, a bottom, or a middle section).

This written description uses examples to disclose multiple embodiments, including the preferred embodiments, and also to enable any person skilled in the art to practice the invention, including making and using any devices or systems and performing any incorporated methods. Aspects from the various embodiments described, as well as other known equivalents for each such aspects, can be mixed and matched by one of ordinary skill in the art to construct additional embodiments and techniques in accordance with principles of this application.

Those in the art will appreciate that various adaptations and modifications of the above-described embodiments can be configured without departing from the scope and spirit of the claims. Therefore, it is to be understood that the claims may be practiced other than as specifically described herein.

What is claimed:

1. A stackable child's toy comprising:

a first toy body comprising a plurality of surfaces;

a first bubble level oriented in a first direction and disposed within a first surface of the plurality of surfaces;

a second bubble level oriented in a second direction and disposed within a second surface of the plurality of surfaces; and a plurality of leveling posts to be used in conjunction with a second toy body disposed above the first toy body, wherein the plurality of leveling posts are located on a top surface third surface of the plurality of surfaces of the first toy body.

2. The stackable toy of claim 1, wherein each of the plurality of leveling posts comprises a post, a cam, or a screw.

3. The stackable toy of claim 1, wherein each of the plurality of leveling posts are located in corners of the first toy body.

4. The stackable toy of claim 1, wherein each of the plurality of leveling posts are configured to jack the first toy body up or down.

5. The stackable toy of claim 1, wherein each of the plurality of leveling posts are configured move, up or down, independently to level a child's toy that rests on top of plurality of leveling posts.

6. The stackable toy of claim 1, wherein each of the plurality of leveling posts are screwed into the first toy body to adjust an individual height of each of the plurality of leveling posts.

7. The stackable toy of claim 1, wherein each of the plurality of leveling posts are threaded.

8. The stackable toy of claim 1, wherein each of the plurality of leveling posts comprise a top portion that extends beyond a diameter of the leveling post to allow for each of the plurality of leveling posts to be turned.

9. A stackable child's toy comprising:

a first toy body comprising a plurality of surfaces;

a first bubble level oriented in a first direction and disposed within a first surface of the plurality of surfaces;

a second bubble level oriented in a second direction and disposed within a second surface of the plurality of surfaces; and a plurality of leveling posts located to be used in conjunction with a second toy body disposed above the first toy body, wherein the plurality of leveling posts located on a third surface of the plurality of surfaces of the first toy body, wherein each of the plurality of leveling posts comprises a post, a cam, or a screw, wherein each of the plurality of leveling posts are located in corners of the first toy body and wherein each of the plurality of leveling posts are configured to move, up or down.

10. The stackable toy of claim 9, wherein each of the plurality of leveling posts are screwed into the first toy body to adjust an individual height of each of the plurality of leveling posts.

11. The stackable toy of claim 9, wherein each of the plurality of leveling posts are threaded.

12. The stackable toy of claim 9, wherein each of the plurality of leveling posts comprise a top portion that extends beyond a diameter of the leveling post to allow for each of the plurality of leveling posts to be turned.

13. A stackable child's toy comprising:

a first toy body comprising a plurality of surfaces;

a first bubble level oriented in a first direction and disposed within a first surface of the plurality of surfaces;

a second bubble level oriented in a second direction and disposed within a second surface of the plurality of surfaces; and a plurality of leveling posts located to be used in conjunction with a second toy body disposed above the first toy body, wherein the plurality of leveling posts located on a third surface of the plurality of surfaces of the first toy body, wherein each of the plurality of leveling posts comprises a post, a cam, or a screw, wherein each of the plurality of leveling posts are located in corners of the first toy body, wherein each of the plurality of leveling posts are configured to move, up or down and wherein each of the plurality of leveling posts comprise a top portion that extends beyond a diameter of the leveling post to allow for each of the plurality of leveling posts to be turned.

14. The stackable toy of claim 13, wherein each of the plurality of leveling posts are screwed into the first toy body to adjust an individual height of each of the plurality of leveling posts.

15. The stackable toy of claim 13, wherein each of the plurality of leveling posts are threaded.

* * * * *